United States Patent [19]

Huff et al.

[11] Patent Number: 4,634,187

[45] Date of Patent: Jan. 6, 1987

[54] METHOD OF IN-SITU LEACHING OF ORES

[75] Inventors: Ray V. Huff; Steven G. Axen; Baughman, David R., all of Golden, Colo.

[73] Assignee: ISL Ventures, Inc., San Francisco, Calif.

[21] Appl. No.: 674,026

[22] Filed: Nov. 21, 1984

[51] Int. Cl.[4] ..... E21B 43/28; E21B 43/30

[52] U.S. Cl. ..... 299/4; 166/271; 166/281; 299/11; 405/53; 405/57; 405/128

[58] Field of Search ..... 166/245, 271, 281, 292; 299/4, 5, 11; 405/55, 57, 58, 59, 128, 53

[56] References Cited

U.S. PATENT DOCUMENTS

| | | | |
|---|---|---|---|
| 2,390,770 | 12/1945 | Barton et al. | 166/261 X |
| 2,642,943 | 6/1953 | Smith et al. | 166/261 |
| 2,970,645 | 2/1961 | Glass | 166/281 |
| 3,152,640 | 10/1964 | Marx | 405/59 X |
| 3,237,690 | 3/1966 | Karp et al. | 166/281 |
| 3,309,141 | 3/1967 | Fitch et al. | 299/4 X |
| 3,819,231 | 6/1974 | Fehlner | 299/4 |
| 4,289,354 | 9/1981 | Zakiewicz | 299/4 |
| 4,305,463 | 12/1981 | Zakiewicz | 166/281 |
| 4,311,340 | 1/1982 | Lyons et al. | 299/4 |
| 4,561,696 | 12/1985 | Graves | 299/4 |

*Primary Examiner*—George A. Suchfield

[57] ABSTRACT

A method of in-situ leaching is disclosed in which the ore body is incapsulated by impermeable barriers. A grid of injection and production wells are drilled into the ore body. Horizontal barriers are formed at the top and bottom of the ore body by creating an overlapping pattern of horizontally-oriented fractures filled with polymer, above and below the ore body, radiating from each of the injection and production wells. A ring of boundary wells may also be drilled surrounding the ore body. The strata around each boundary well is fractured and a polymer is then injected to form a vertical barrier around the periphery of the ore body. The lixiviant is then introduced to extract the desired mineral values. In addition, water may be injected under pressure into guard wells between the ore body and the vertical and/or horizontal barrier wells to further reduce any migration of lixiviant into neighboring formations.

5 Claims, 10 Drawing Figures

METHOD OF IN-SITU LEACHING OF ORES

FIELD OF THE INVENTION

The present invention relates generally to in-situ leaching of mineral values from subterranean formations. More specifically, this invention is a method of encapsulating the ore value within impermeable barriers to confine the migration of the lixiviant, thus controlling loss of the lixiviant and potential pollution of ground water.

BACKGROUND OF THE INVENTION

In-situ leaching of mineral values from an ore body has been used for many years in the mining industry, particularly in the production of uranium. Generally, a leaching solution or lixiviant is pumped under pressure into the ore body through one or more injection wells. The lixiviant percolates and migrates through the ore body and solubilizes the desired mineral values. The various chemical processes used for this purpose are well described in the literature. The pregnant lixiviant is removed from the ore body through one or more production wells for subsequent processing to extract the solubilized minerals.

One common problem with in-situ leaching has been confinement of the lixiviant within the desired portion of the ore body. Although the pressure differential between the injection and production wells tends to cause the lixiviant to migrate through the ore body toward the production wells, some of the lixiviant will migrate beyond the remaining portions of the ore body and into surrounding formations. This loss of lixiviant is not only an economic loss to the mine operator, but also may result in ground water contamination.

In response to this problem several methods have been developed in the past to produce an impermeable barrier to confine the lixiviant, as shown in the following prior art references:

| Inventor | U.S. Pat. No. | Issue | Title |
|---|---|---|---|
| Lyons | 4,311,340 | 1/19/82 | "Uranium Leaching Process and Insitu" |
| Fehlner | 3,819,231 | 6/25/70 | "Electrochemical Method of Mining" |
| Zakiewicz | 4,289,354 | 9/15/81 | "Borehole Mining of Solid Mineral Resources" |

The Lyons patent most clearly demonstrates the concept of completely encapsulating the ore body. Lyons also teaches use of vertical boundary wells (FIGS. 1–4) to form a vertical curtain of impermeable material around the ore body, as is also shown by Felner. Lyons also teaches that hydrofracturing of these boreholes may be employed to create cracks and passageways in the strata surrounding the boreholes to facilitate greater penetration of the grout or other impermeable materials (columns 7–8). Finally, Lyons discloses that organic polymers and epoxy resins, as well as a wide variety of other materials can be used to create this impermeable barrier.

The primary limitation of Lyons is the manner in which the horizontal barriers are formed above and below the ore body. Lyons relies on slanted boreholes formed by directional drilling for this purpose, as shown in FIGS. 5–11. While this technique may be effective for a relatively small ore body, it quickly becomes impractical when dealing with a large ore body, particularly one having a large horizontal cross-section. In such cases, a radial arrangement of slanted boreholes does not result in a uniform degree of encapsulation of the ore body due to radial diversion of the boreholes. Directional drilling also entails additional costs. Finally, the method disclosed by Lyons is best suited for situations where the top and bottom surfaces of the ore body are regular in contour. In contrast, the present invention eliminates these disadvantages by forming the horizontal barriers as part of the process of completing the injection and production wells.

SUMMARY OF THE INVENTION

In accordance with the present invention, an ore body is encapsulated by impermeable barriers consisting of a vertical barrier around the periphery of the ore body, and horizontal barriers located above and below the ore body. The vertical barriers are formed by drilling a ring of boundary wells around the desired portion of the ore body. The strata surrounding each boundary well may be fractured, if necessary. The surrounding strata is saturated with a polymer or other impermeable material that is injected into each boundary well. The horizontal barriers are formed as part of the process of drilling and completing the injection and production wells that are later used for in-situ leaching. In particular, an overlapping grid of horizontally-oriented fractures are created, above and below the ore body, radiating from each of the injection and production wells. The fractures and some of the adjacent rock are filled with a polymer or other material suitable for forming an impermeable barrier. Sections of the vertical and horizontal barriers may be omitted in those areas where the strata surrounding the ore body is relatively impermeable.

Accordingly, one principal object of the present invention is to provide a more effective and economical method of encapsulating an ore body for in-situ leaching of mineral values.

Another object of the present invention is to provide a method of encapsulating an ore body where the injection and production wells also are used in creating the top and bottom horizontal barriers for the ore body.

Still other objects, features, and advantages of the present invention will be made apparent by the following detailed description, the drawings, and the claims.

DETAILED DESCRIPTION OF THE INVENTION

Figure 1:
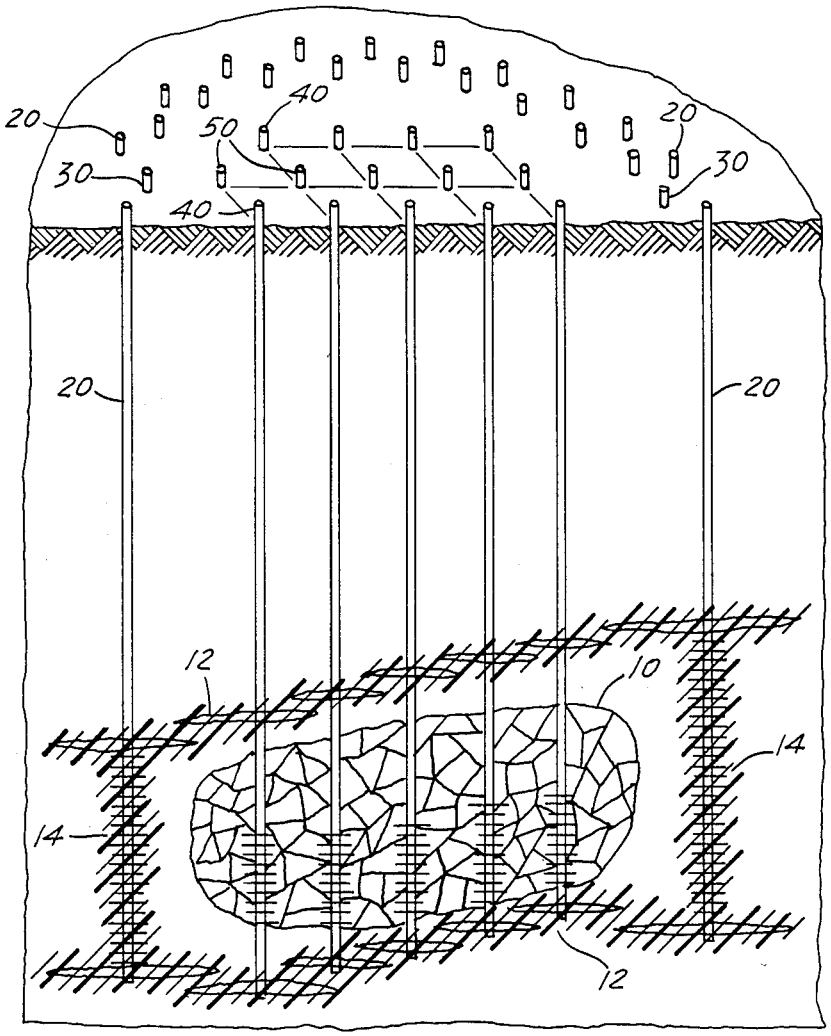
FIG. 1 is a schematic representation of a cross-section of the earth's structure showing an ore body, rings of barrier wells and guard wells surrounding the ore body, and a grid of injection and production wells.

Turning to the drawings, FIG. 1 is a cross-section of the earth's structure showing an ore body 10 that has been encapsulated by impermeable vertical barriers 12 and horizontal barriers 14. Viewed from the surface of the earth, the ore body is surrounded by a ring of boundary wells 20. Within this ring is a second ring of guard wells 30 that also surrounds a grid of injection wells 40 and production wells 50.

Figure 2:
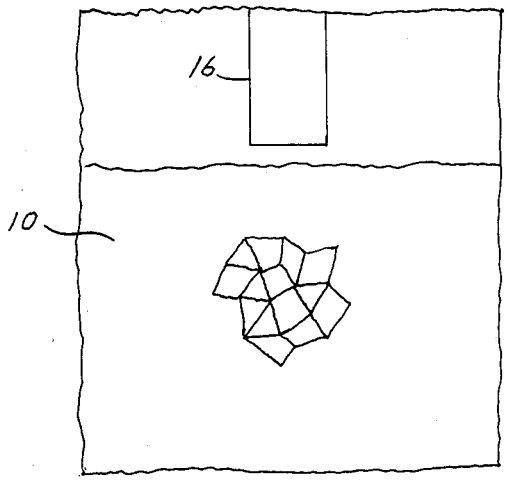
FIG. 2 is a schematic representation of the bottom end of a borehole directly above the top surface of the ore body shown in FIG. 1.
Figure 3:
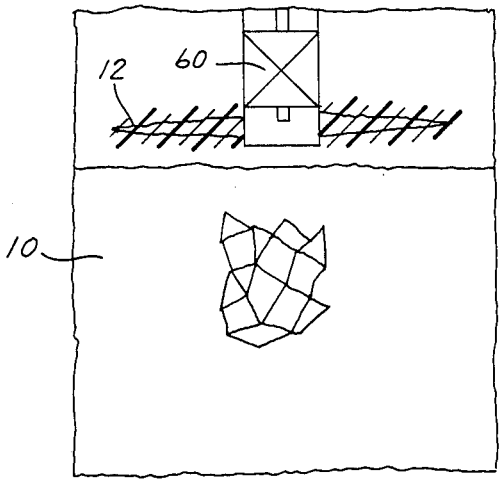
FIG. 3 is a schematic representation of the borehole in FIG. 2, further showing a hydraulic packer and a horizontally-oriented fracture extending above the top surface of the ore body filled with impermeable material.

FIGS. 2 through 6 give a step-by-step progression of the method employed to form the horizontal barriers for a typical injection or production well. As shown in FIG. 2, a borehole 16 is drilled by conventional means from the surface of the earth to a point above the top surface of the ore body where the upper horizontal barrier is to be created. A hydraulic packer 60 is then lowered into the borehole, as shown in FIG. 3, and the strata surrounding the borehole below the packer is hydraulically fractured by injecting fluid at high pressure through the packer and into the bottom end of the borehole. The orientation and extent of fracturing can be predicted with some degree of certainty based on the physical characteristics of the strata and the stress conditions of the formation. The technology in this area has been well developed in the petroleum industry. See, G. C. Howard & C. R. Fast, *Hydraulic Fracturing* (Monograph Volume 2, Society of Petroleum Engineers of A.I.M.E., 1970). After creating the horizontally-oriented fractures, an impermeable material such as a plastic polymer, epoxy resins, silica gel, cement or grout is injected through the packer into the fractured formation to create the impermeable barrier 12. Polymers of the polyacrylamide family are particularly appropriate for this purpose and are available on the market under product names such as American Cyanamid Cyanogel 100 or 150, Halliburton Services KTROL, and Dow Well M-174.

Figure 4:
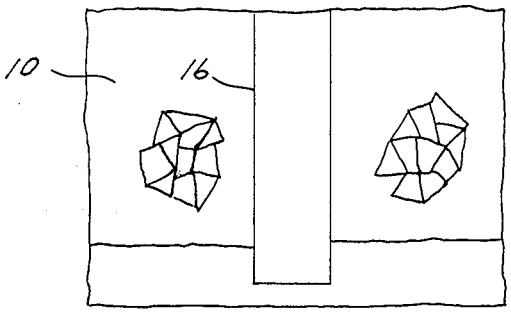
FIG. 4 is a schematic representation showing the borehole continued down below the bottom of the ore body.
Figure 5:
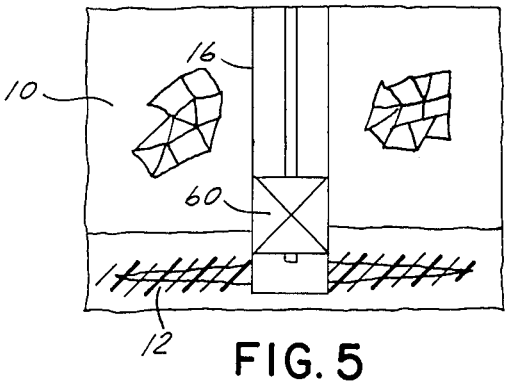
FIG. 5 is a schematic representation showing a hydraulic packer and a horizontally-oriented fracture extending below the bottom of the ore body filled with impermeable materials.
Figure 6:
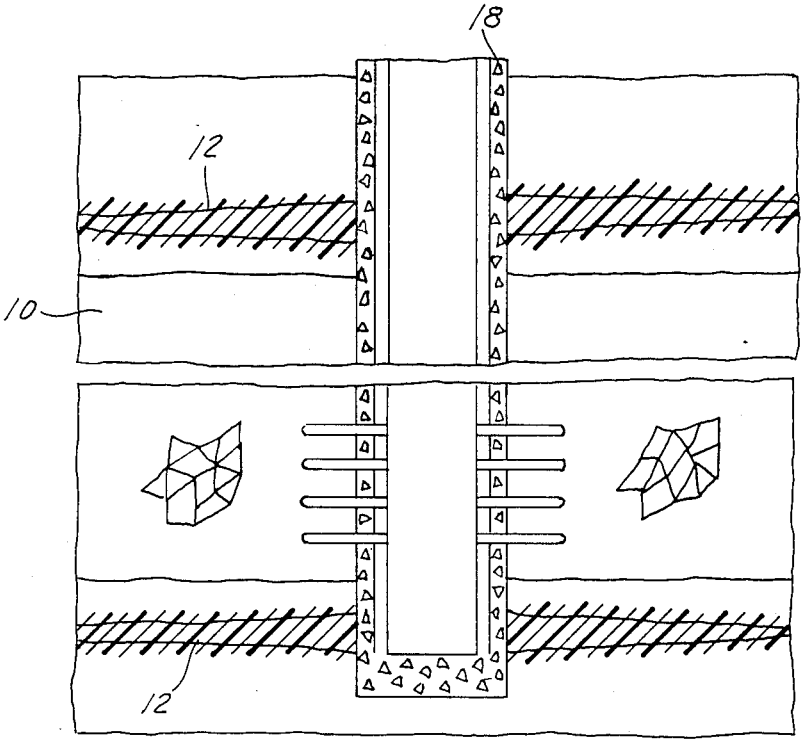
FIG. 6 is a schematic representation showing the completed injection or production well with its casing and lining, and perforations into the surrounding ore body.

After this upper horizontal barrier has had ample time to solidify or set, drilling of the borehole 16 is continued through the ore body 10 and slightly beyond into the formation below, as shown in FIG. 4. Once again, a packer 60 is lowered to the bottom of the borehole and the formation around the bottom of the borehole was fractured and injected with an impermeable material, as shown in FIG. 5. The borehole was then completed in the conventional manner with a casing and cement 18 as shown in FIG. 6. The casing and cement are perforated by means of shaped explosive charges to allow the lixiviant to be injected into, or drain out of the ore body.

The optimal spacing of the grid of injection and production wells can vary widely depending primarily on the permeability of the ore body and the radius of fracturing associated with the horizontal barriers about each injection and production well. The spacing of the well grid should be small enough to allow the horizontal barriers to overlap, so as to prevent migration of the lixiviant into neighboring formations. With adequate fracturing of formations having a suitably high permeability, the grid spacing between wells may be as great as 50 feet or more.

This method of creating horizontal barriers provides a substantial advantage in that the barriers can be contoured to follow irregularities in the top and/or bottom surfaces of the desired ore body. Although the fractures radiating from the injection and production wells have a primarily horizontal orientation, migration of the barrier-forming material into the strata results in horizontal barriers having a substantial vertical thickness. Thus, neighboring horizontal fractures need not be in strict horizontal alignment in order to overlap. By progressively increasing or decreasing the vertical depth of the horizontally-oriented fractures, a sloping barrier can be formed in steps. Similarly, the vertical depth of the horizontally-oriented fractures can be varied over a small portion of the well grid to compensate for irregularities in the surface of the ore body.

Alternatively, the horizontal barriers can be formed using less than all of the injection and production wells. For example, if the formations are relatively permeable or if the radius of fracturing is sufficiently great, creating horizontally-oriented fractures only from every second well in the grid may be satisfactory to complete the horizontal barriers. Vertical barriers 14 are formed in a similar manner for each boundary well around the periphery of the ore body, or any desired section thereof. Although the boundary wells are usually located outside of the ore body, horizontally-oriented fractures 70 and 75 are generally created in accordance with the method described in FIGS. 2 through 6, in order to complete the edges of the overlapping grid of horizontal fractures from the injection and production wells. In order to avoid gaps in the vertical barrier around the periphery of the ore body, there must be some degree of overlap in areas saturated with impermeable material radiating from each set of neighboring boundary wells. The entire length of the borehole for each boundary well may be hydraulically fractured between the upper and lower horizontal barriers to increase permeability of the barrier-forming material into the surrounding strata. However, if the native permeability of the surrounding strata is sufficiently great, the need for fracturing may be reduced or entirely eliminated.

Figure 7:
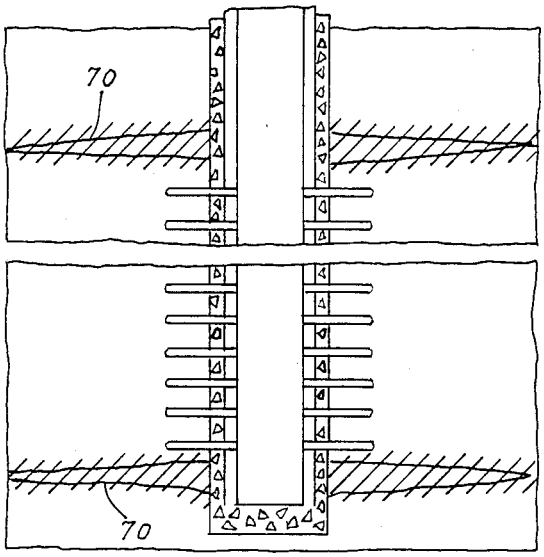
FIG. 7 is a schematic representation of a barrier well located outside of the ore body, but otherwise created by the method shown in FIGS. 1–6.
Figure 8:
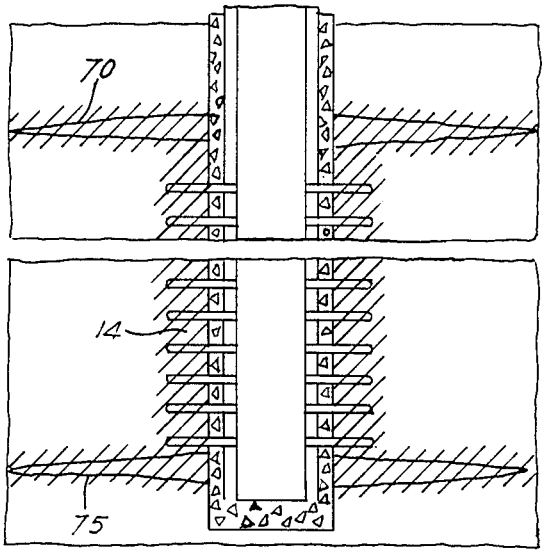
FIG. 8 is a schematic representation of the completed barrier well filled with impermeable material.
Figure 9:
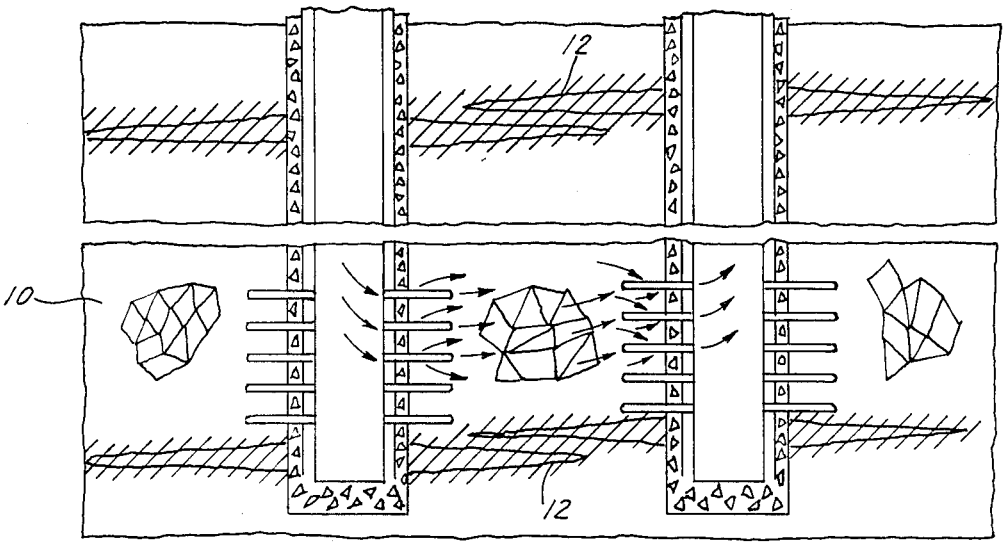
FIG. 9 is a schematic representation showing the flow of the lixiviant through a portion of the ore body from an injection well to a production well.

In either case, the boundary wells are usually cased and cemented. FIG. 7 is analogous to FIG. 6 with the exception that the casing and cement are perforated the entire distance between the upper and lower horizontal barriers. FIG. 8 shows a completed boundary well that has been injected with an impermeable material saturating the formation around the boundary well between the upper and lower horizontal barriers through the perforations in the casing and cement.

The purpose of the preceding steps is to completely encapsulate the ore body in all directions. Horizontal migration of the lixiviant out of the ore body is prevented by the vertical barrier 14 of impermeable material injected through the ring of boundary wells about the periphery of the ore body. As previously discussed, the overlapping pattern of horizontally-oriented fractures, injected with impermeable material, radiating from the injection and production wells creates horizontal barriers 12 above and below the ore body. The horizontally-oriented fractures 70 and 75 above and below the ore body radiating from the boundary wells complete the encapsulation by joining together the edges of the horizontal barriers and the vertical barrier.

The preceding discussion has assumed that complete encapsulation of the ore body by artificial means is necessary. This is not always the case. For example, if some portion of the ore body is bounded by a relatively impermeable natural formation, that portion of the artificial barrier that would otherwise be created using the present invention can be accordingly reduced or eliminated. In particular, if the ore body lies directly above or below an impermeable strata, the corresponding upper or lower horizontal barrier can be omitted.

Figure 10:
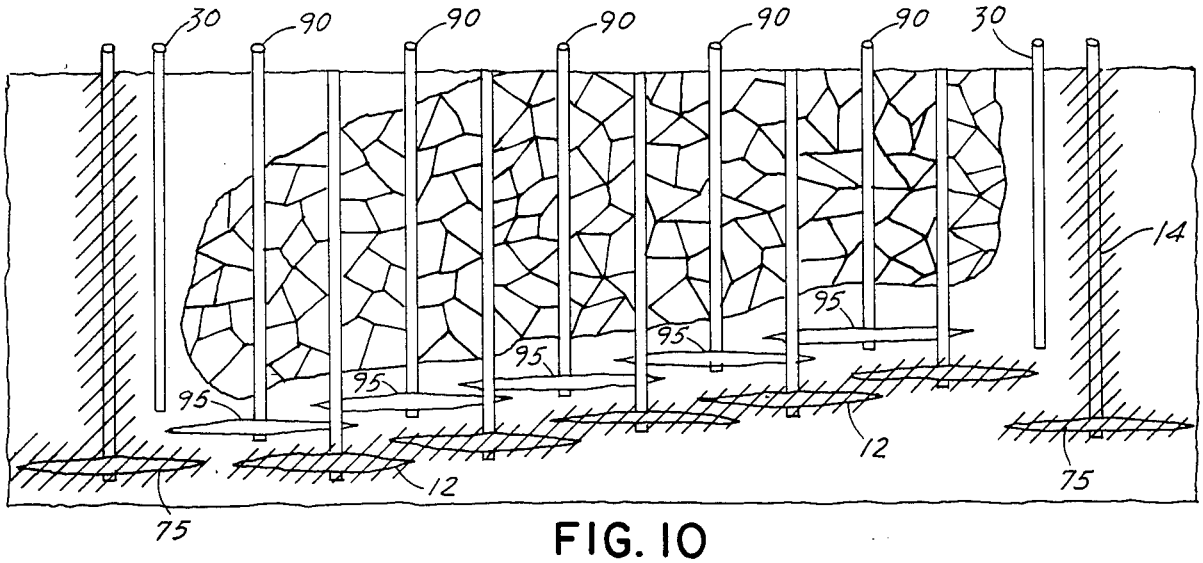
FIG. 10 is a schematic representation showing a vertical cross-section of the bottom portion of the ore body, the bottom portions of the barrier and guard wells, the horizontal barrier below the ore body, and the use of horizontally-oriented fractures between the ore body and the horizontal barrier.

FIGS. 1 and 10 show a ring of guard wells 30 within the boundary wells. Ideally the horizontal and vertical barriers described above will be highly effective in containing the lixiviant within the desired portion of the ore body. However, to minimize the effect of any gaps or leakages in the barriers, the guard wells are pressurized with water. This tends to negate any pressure gradient created by the injection wells that would otherwise tend to cause lixiviant to migrate outward into neighboring formations.

The general concept of pressurizing the boundary of the ore body with water to minimize migration of the lixiviant into neighboring formations can be extended to the horizontal barriers as well, as shown in FIG. 10. In addition to the ring of guard wells 30, shown in FIGS. 1 and 10, additional guard well 90 is employed to inject water under pressure between the horizontal barriers and the ore body. The upper guard wells are drilled to a depth below the bottom of the upper horizontal barrier, and above the top surface of the ore body. A hydraulic packer is then lowered into the borehole, and the strata surrounding the bottom of the borehole is fractured to create an overlapping pattern of horizontally-oriented fractures, similar to the method used to create the horizontal barriers. The borehole of each guard well is lined and cemented. However, instead of injecting material to form an impermeable barrier in the fractures at the bottom of the guard wells, the fractures are propped open by injecting sand or glass beads. Either by extending these guard wells through the ore body, or by drilling another set of guard wells, an overlapping pattern of horizontally oriented fractures 95 can also be formed between the bottom surface of the ore body and the lower horizontal barrier. As lixiviant is injected into the injection wells, water is injected under pressure into these fractures, both above and below the ore body, through the guard wells.

Following completion of the impermeable barriers and guard wells, the lixiviant is introduced into the ore body through the injection wells. The lixiviant migrates through ore body and solubilizes the desired mineral values. Injection and recovery of the lixiviant through the injection and production wells are accomplished by conventional means.

It will be apparent to those skilled in the art that many variations and modifications of the present invention may be made without departing from the spirit and scope of the invention.

We claim:

1. A method of in-situ leaching of ore bodies comprising:

(a) Drilling a ring of boundary wells about the periphery of the desired ore body; fracturing the strata surrounding a number of the boundary well; and inject into each boundary well and the surrounding strata a material to form an impermeable barrier;

(b) Drilling a number of wells within the area enclosed by the boundary wells to a depth above the top surface of the desired ore body;

(c) Creating an overlapping pattern of horizontally-oriented fractures in the strata around the bottom of said wells, and injecting into said fractures and the surrounding strata a material to form an impermeable barrier;

(d) Continued drilling of said wells through the desired ore body;

(e) Creating an overlapping pattern of horizontally-oriented fractures in the strata around the bottom of said wells, and injecting an into said fracture and the surrounding strata a material to form an impermeable barrier;

(f) Injecting a lixiviant through a number of said wells into the ore body to solubilize the desired mineral values, and recovering the pregnant lixiviant from the ore body through a number of said wells.

2. The method of claim 1, wherein the drilling and fracturing of the boundary wells comprise:

(a) Drilling a ring of boundary wells about the periphery of the desired ore body with an initial depth of each boundary well in horizontal alignment with the horizontal barrier above the ore body;

(b) Creating horizontally-oriented fractures in the strata around the bottom of said boundary wells, and injecting into said fractures and the surrounding strata a material to form an impermeable barrier;

(c) Continued drilling of said boundary wells to a depth in horizontal alignment with the horizontal barrier below the ore body;

(d) Creating horizontally-oriented fractures in the strata around the bottom of said boundary wells, and injecting into said fractures and the surrounding strata a material to form an impermeable barrier; and (e) Fracturing the strata around the boundary wells between the upper and lower horizontally-oriented fractures and injecting an impermeable material into said fractures to form an impermeable barrier.

3. The method of claim 1, further comprising:

(a) Drilling a ring of guard wells within the ring of boundary wells, enclosing the remaining wells; and (b) Injecting water into the guard wells under pressure as the lixiviant is injected into the ore body.

4. The method of claim 1, further comprising:

(a) Drilling a number guard wells within the area enclosed by the boundary wells to a depth between either of the horizontal barriers and the adjacent surface of the desired ore body;

(b) Creating an overlapping pattern of horizontally-oriented fractures in the strata around the bottom of said guard wells;

(c) Injecting water into the guard wells under pressure as the lixiviant is injected into the ore body.

5. A method of in-situ leaching of ore bodies comprising:

(a) Drilling a number of wells to a depth above the top surface of the desired ore body;

(b) Fracturing the strata around the bottom of the wells, (c) Injecting a material to form an impermeable barrier into said fractures and the surrounding strata;

(d) Continued drilling of said wells through the desired ore body;

(e) Fracturing the strata around the bottom of the wells;

(f) Injecting a material to form an impermeable barrier into said fractures and the surrounding strata;

(g) Injecting a lixiviant through a number of said wells into the ore body to solubilize the desired mineral values, and recovering the pregnant lixiviant from the ore body through a number of said wells.

* * * * *